US006783377B2

(12) United States Patent
Aoyama

(10) Patent No.: US 6,783,377 B2
(45) Date of Patent: Aug. 31, 2004

(54) GROUND TERMINAL AND METHOD OF FORMING IT

(75) Inventor: Masahiko Aoyama, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/320,857

(22) Filed: Dec. 16, 2002

(65) Prior Publication Data

US 2003/0124917 A1 Jul. 3, 2003

(30) Foreign Application Priority Data

Dec. 27, 2001 (JP) ..... 2001-397853

(51) Int. Cl.[7] ..... H01R 13/648
(52) U.S. Cl. ..... 439/92; 439/96; 439/95
(58) Field of Search ..... 439/92, 95, 96, 439/801, 886, 883, 469, 460, 97, 859; 174/51

(56) References Cited

U.S. PATENT DOCUMENTS 1,847,689 A * 3/1932 Gribbie
6,126,493 A * 10/2000 Price et al. ..... 439/801

FOREIGN PATENT DOCUMENTS

JP 9-92360 4/1997

* cited by examiner

*Primary Examiner*—Alex Gilman
(74) *Attorney, Agent, or Firm*—Gerald E. Hespos; Anthony J. Casella

(57) ABSTRACT

A ground terminal (11) has a fixing portion (12) formed with a bolt hole (12*a*) for receiving a bolt (B) for fixing the fixing portion (12) to a mount member (A), a wire-connecting portion (13) for fixing a wire, and a coupling portion (14) between the fixing portion (12) and the wire-connecting portion (13). The coupling portion (14) is formed with a pointed fracture groove (15) extending in widthwise direction and having an apex (15*a*) symmetrically disposed the coupling portion (14). The ground terminal (11) can be easily fractured and separated with the apex (15*a*) of the fracture groove (15) as a fracture starting point by lifting the wire connecting portion (13) up to bend the ground terminal (11).

16 Claims, 5 Drawing Sheets

GROUND TERMINAL AND METHOD OF FORMING IT

BACKGROUND OF THE INVENTION

1. Field of the Invention

The invention relates to a ground terminal that can be detached easily from the body of an automotive vehicle or the like at the time of dismantling, and to a method of forming such ground terminal.

2. Description of the Related Art

Ground wires are connected with the wire-connecting portions of ground terminals and the ground terminals are connected to bolts on the body of a vehicle. In recent years, there has been a demand for recycling parts of dismantled automotive vehicles. Accordingly, nonmetallic parts, such as wiring harnesses, are removed from metallic vehicle bodies. However, the ground terminals that are part of the wiring harnesses are fixed firmly to the vehicle body by the bolts, and they can be removed only by a labor-intensive operation, such as loosening the bolts.

Japanese Unexamined Patent Publication No. 9-92360 and FIG. 7 herein disclose a ground terminal that enables the wire and adjacent parts of a ground terminal to be removed from a vehicle body without loosening the bolt. In particular, a ground terminal 1 of FIG. 7 has a fixing portion 2 for fixing the ground terminal 1 to a vehicle body. The ground terminal 1 also has a wire-connecting portion 3 for connection to a wire and a coupling portion 4 between the fixing portion 2 and the wire-connecting portion 3. A groove 5 extends straight across the coupling portion 4 in the widthwise direction and defines a thin region of the coupling portion 4. The wire-connecting portion 3 can be gripped and bent repeatedly up and down to fracture the ground terminal 1 along the groove 5. As a result, the wire, the fixing portion 2 and adjacent parts of the coupling portion 4 can be separated from the fixing portion 2.

The ground terminal 1 is fractured due to metallic fatigue caused by bending along the groove 5. However, a strenuous bending operation is required to fracture the ground terminal 1. The groove 5 could be deepened to make the thinned portion even thinner and to facilitate the fracture of the ground terminal 1. However, the ground terminal 1 also becomes weaker against a pulling force along the longitudinal direction of the wire and there is a danger of inadvertent fracture. Further, a deep groove 5 defines a small a cross-sectional area and may exhibit insufficient electrical conductivity.

The invention was developed in view of the above, and an object thereof is to make a ground terminal separable at a coupling portion by light bending without reducing a sectional area of a portion to be fractured.

SUMMARY OF THE INVENTION

The invention relates to a ground terminal with a fixing portion formed with a bolt hole for receiving a bolt and/or a threaded shaft for fixing the ground terminal to a mount member. The ground terminal further includes a wire-connecting portion for connection to a wire and a coupling portion that joins the fixing portion and the wire-connecting portion. The coupling portion is thinned across substantially its entire width to form a fracture groove. The fracture groove is pointed, arrow-shaped or arch-shaped, and preferably has an apex substantially at the widthwise center of the coupling portion.

The fracture groove may be continuous or discontinuous, and may have a constant width or a varying width. Further, the pointed shape of the fracture groove may be a V-shape with a sharply pointed apex or a moderate curved parabolic shape. The fracture groove may take any shape, but preferably has the apex substantially in the center of the coupling portion. It does not matter whether the pointed tip faces toward the fixing portion or toward the wire-connecting portion.

The wire-connecting portion may be lifted up and bent with respect to the fixing portion that is bolted to the mount member of an automotive vehicle or the like. Thus, a fracture area gradually spreads along the fracture groove from the pointed apex, as a fracture starting point, to the opposite widthwise ends of the coupling portion. Thus, the ground terminal can be fractured and separated along the fracture groove substantially by one bending operation, and the fixing portion and part of the coupling portion are left behind. An operation force for the fracture can be reduced and a sectional area of the fracture groove can be set larger as compared to conventional straight fracture grooves. Thus, the ground terminal has sufficient strength against a pulling force on the wire. Further, the sectional area of the fracture groove can be enlarged, and the electrical conductivity of the ground terminal can be improved as compared to the straight fracture grooves.

The fracture groove preferably is formed in the surface of the coupling portion that faces the mount member. Thus, a lifting force on the wire-connecting portion widens the fracture groove, and the fracture proceeds easily along the fracture groove.

A projection preferably projects from a surface of the coupling portion opposite the fracture groove. The projection preferably is at a location substantially nested with the concave side of the apex of the fracture groove. The projection performs a reinforcing function and concentrates stress at the apex of the fracture groove, as a fracture starting point. Thus, the fracture can be started more easily when the wire-connecting portion is lifted to bend the ground terminal.

A bore may be formed at the apex of the fracture groove. The bore enables the fracture to be started more smoothly from the apex of the fracture groove.

The invention also relates to a method for forming a ground terminal. The method comprises stamping or cutting out a conductive plate to provide a fixing portion formed with a bolt opening for receiving a bolt and/or threaded shaft for fixing the fixing portion to a mount member. The method further comprises forming a wire-connecting portion for fixing a wire, and forming a coupling portion for coupling the fixing portion and the wire-connecting portion. The step of forming the coupling portion comprises forming a fracture groove by thinning the coupling portion over substantially the entire width thereof. The fracture groove is formed to have a pointed, arrow or arch-shape and may have an apex substantially toward the widthwise center of the coupling portion. Additionally, the fracture groove may be formed in a surface of the coupling portion that will face the mount member.

The method may further comprise the step of forming a projection on the coupling portion at a position proximate to the concave side of the apex of the fracture groove. Additionally, the projection is formed on a surface opposite from the one where the fracture groove is formed.

The method further may comprise the step of forming a bore at or near the apex of the fracture groove.

These and other objects, features and advantages of the invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1A:
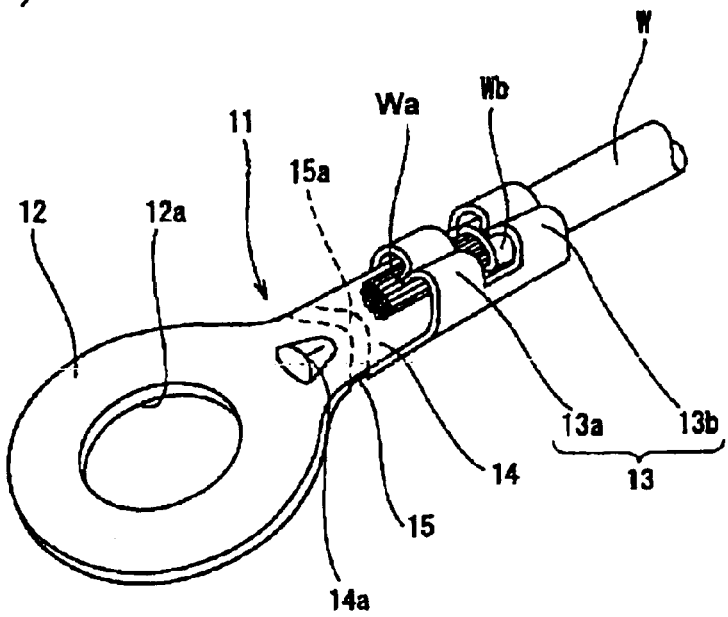
FIG. 1(A) is a perspective view of a ground terminal according to a first embodiment of the present invention.
Figure 1B:
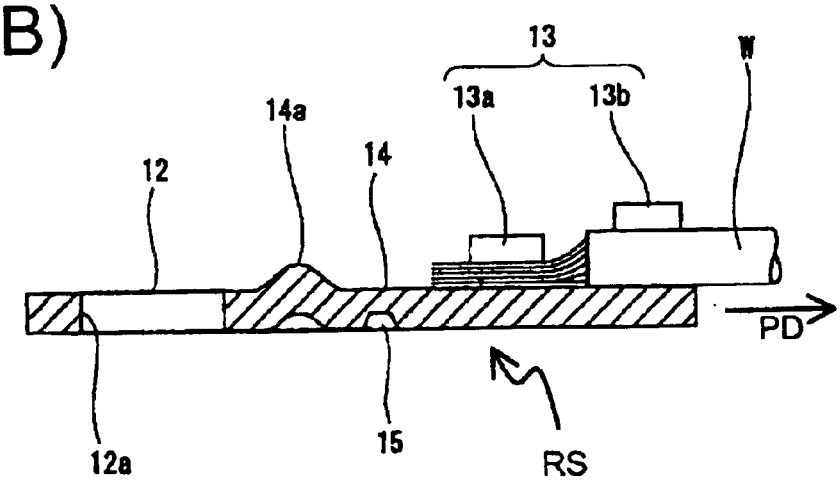
FIG. 1(B) is a side sectional view thereof.

A ground terminal 11 of a first embodiment is shown in FIGS. 1 to 4. The ground terminal 11 is formed by bending, folding and/or embossing a metallic or conductive plate stamped or cut out into a specified shape. A substantially disk-shaped fixing portion 12 is formed at one end of the ground terminal 11. The fixing portion 12 is formed with a bolt opening 12*a* for receiving a bolt B for fixing the ground terminal 11 to a mount member A of an automotive vehicle or the like. The bolt opening 12*a* may be a closed hole 12*a* (as shown) or may be open at one part (not shown) so that the fixing portion is substantially U-shaped. Moreover, the fixing portion 12 also can be fixed to the mount member A by a threaded shaft onto which a nut (not shown) can be threaded.

A wire-connecting portion 13 is formed at the end of the ground terminal opposite the fixing portion 12. The wire connecting portion 13 has a base for receiving a wire W. Two wire barrels 13*a* and two insulation barrels 13*b* extend from opposite sides of a base. The wire barrels 13*a* are crimped, bent or folded into connection with an exposed core Wa at an end of the wire W, whereas the insulation barrels 13 are crimped, folded or bent into connection with an insulated portion Wb of the wire W.

A coupling portion 14 extends between the fixing portion 12 and the wire-connecting portion 13 and preferably has substantially the same width as the wire-connecting portion 13. A fracture groove 15 is formed in the rear surface RS of the coupling portion 14, which is the surface that will face the mount member A. The fracture groove 15 is continuous and of substantially constant width in the illustrated embodiments. However, the fracture groove may be discontinuous, and may have a varying width. The fracture groove 15 is pointed, arrow-shaped or arch-shaped with an apex 15*a* oriented convexly toward the wire-connecting portion 13. Thus, the fracture groove 15 extends obliquely toward a widthwise center from the opposite sides of the fixing portion 12. The fracture groove may be a V-shape with a sharply pointed end or a moderate curved parabolic shape. The fracture groove may take other shapes with an apex substantially in the center of the coupling portion 14. By forming the fracture groove 15 to be pointed, arrow-shaped or arch-shaped, a sectional area of the fracture groove 15 can be enlarged to enhance tensile strength and improve electrical conductivity, as compared to a fracture groove that simply extends orthogonally across the coupling portion 14. Further, a fracture area can gradually spread out and widened from the apex 15*a* of the fracture groove 15 as a fracture starting point.

The coupling portion 14 also is embossed to form a triangular projection 14*a* located near the concave side of the tip 15*a* of the fracture groove 15. The projection 14*a* is formed by embossing the rear surface RS to project toward the opposite front surface and reinforces areas near the fracture groove 15.

Figure 2:
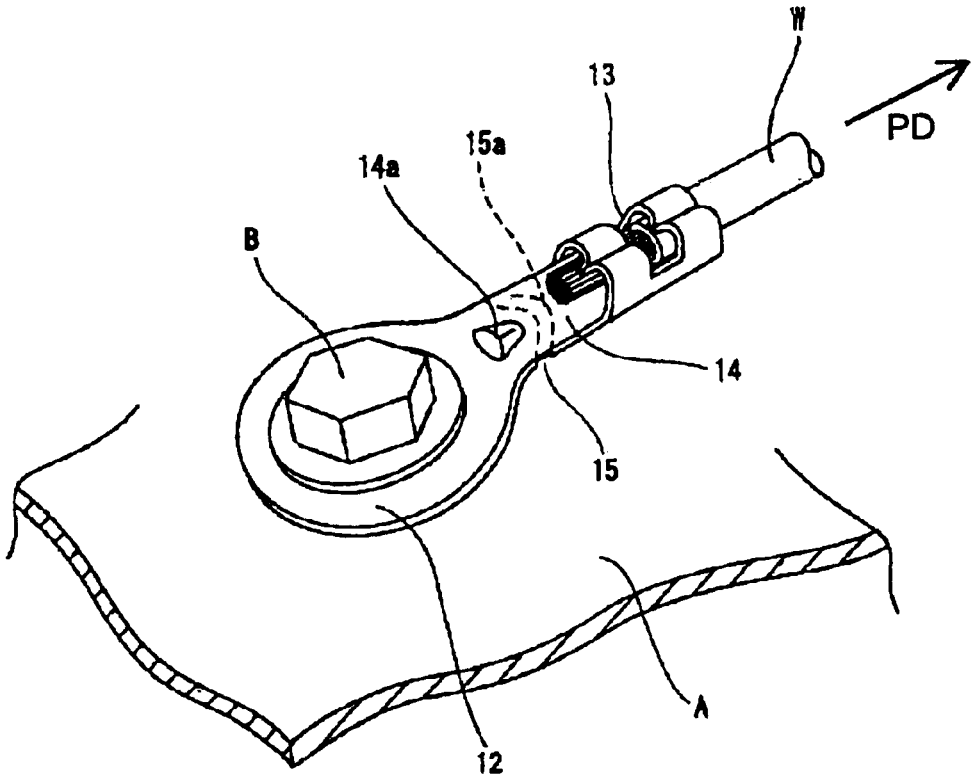
FIG. 2 is a perspective view showing a state where the ground terminal is fixed to a mount member by means of a bolt.

The ground terminal 11 is employed by crimping the wire-connecting portion 13 into connection with the wire W, as shown in FIG. 2. The rear surface RS of the fixing portion 12 of the ground terminal 10 then is placed at a specified position of the mount member A of an automotive vehicle or the like. Then, the ground terminal 10 is fixed by inserting the bolt B through the bolt hole 12*a* and screwing it into an internally threaded portion (not shown) of the mount member A.

Figure 3A:
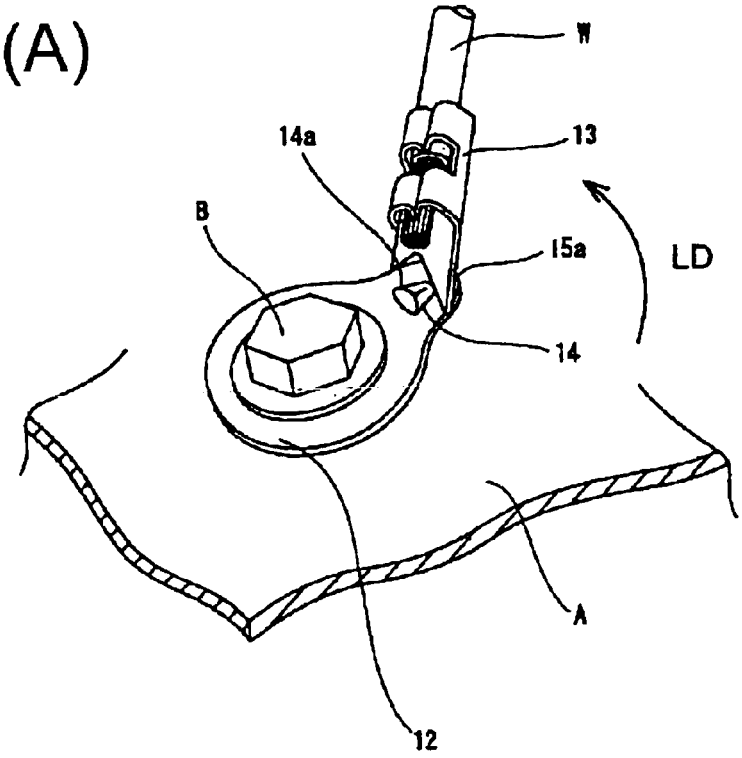
FIG. 3(A) is a perspective view showing the ground terminal being fractured.
Figure 3B:
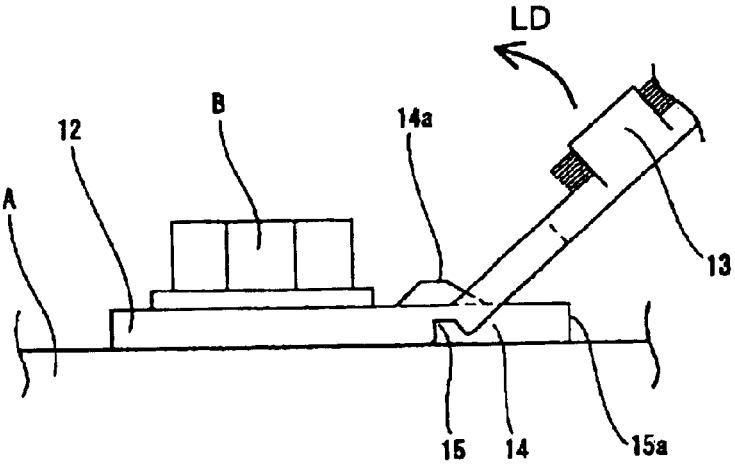
FIG. 3(B) is a side view of an essential portion thereof.
Figure 4:
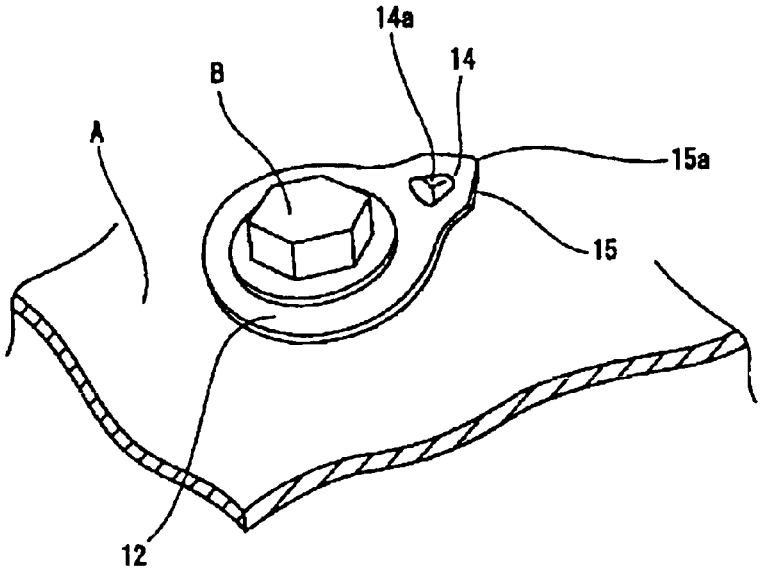
FIG. 4 is a perspective view showing a state after the ground terminal is fractured.

The wire harness may need to be removed out of the vehicle body to recycle parts of the dismantled automotive vehicle. This removal is achieved merely by lifting the wire connecting portion 13 up in the lifting direction LD together with the wire W to bend the ground terminal 11, as shown in FIGS. 3(A) and 3(B). As a result, a stress concentrates on the tip 15*a* of the fracture groove 15, starting the fracture at the apex 15*a*. Thereafter, the fracture area gradually progresses toward the opposite ends of the fracture groove 15, with the result that the wire connecting portion is separated from the fixing portion 12 at the fracture groove 15, leaving only the fixing portion 12 with the bolt B on the mount member A, as shown in FIG. 4.

Fracturing occurs at least partly because the apex 15*a* does not following the wire connecting portion 13 during bending due to the reinforcing effect of the projection 14*a*. The projection 14*a* is embossed to project from the front surface of the coupling portion at a location between the fixing portion 12 and the fracture groove 15. The fixing portion 12 and area between the fixing portion 12 and the fracture groove 15 remain in close contact with the mount member A due to the reinforcing effect the of the projection 14*a*, as shown in FIG. 3(B). Thus, the fracture gradually and smoothly proceeds from the apex 15*a* of the fracture groove 15 to the opposite sides thereof. In this way, the wire-connecting portion 13 can be separated from the fixing portion 12 by only one lifting operation.

The gradual propagation of the fracture from the center along the fracture groove 15 permits a smaller operating force, as compared to a case where the ground terminal 1 is fractured at once along a linear widthwise groove. Further, the fracture groove 15 is formed in the rear surface RS of the wire connecting portion 13. Therefore, a force in the lifting direction LD widens the fracture groove 15 when the wire-connecting portion 13 is lifted. Therefore, the operation of fracturing the ground terminal 1 is easier.

The fracture groove 15 is pointed, arrow-shaped or arch-shaped. Thus, the sectional area thereof is large as compared to a fracture groove that extends linearly across the coupling portion 14. This makes the ground terminal 1 stronger against forces in a pulling direction PD of the wire W and prevents inadvertent fracture.

Figure 5:
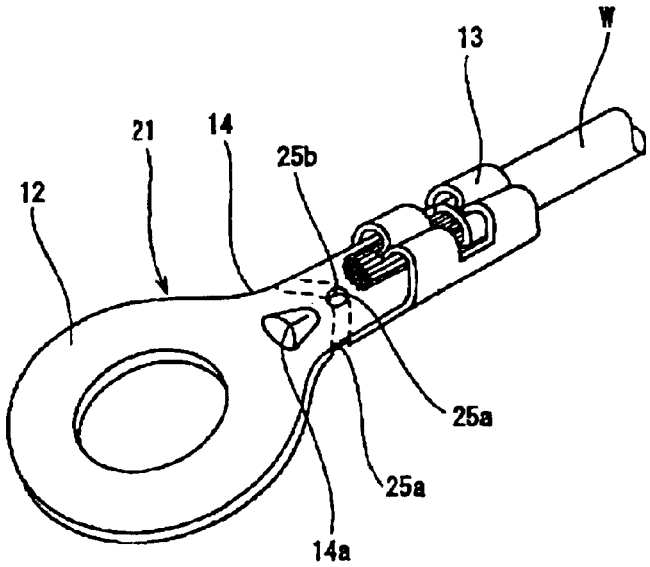
FIG. 5 is a perspective view of a ground terminal according to a second embodiment.

A ground terminal 21 of a second embodiment is shown in FIG. 5. The ground terminal 21 has a coupling portion 24 with a fracture groove 25 with an apex 25*a* similar to the fracture groove 15 and apex 15*a* described above. However, a bore 25*b* is formed at the apex 25*a* of the fracture groove 25. Other elements of the ground terminal 21 are similar to or the same as the first embodiment and merely are identified by the same reference numerals. The bore 25*b* enables a fracture to start more easily when the wire-connecting portion 13 is lifted up to bend the ground terminal 11.

Figure 6:
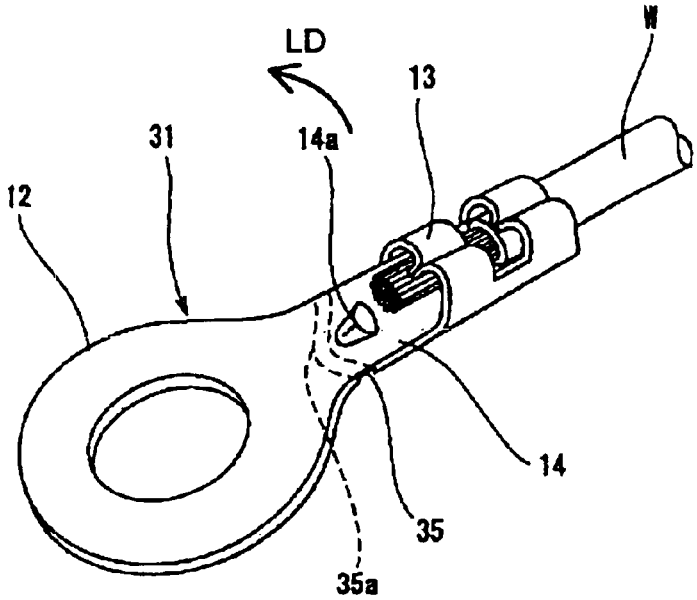
FIG. 6 is a perspective view of a ground terminal according to a third embodiment.
Figure 7:
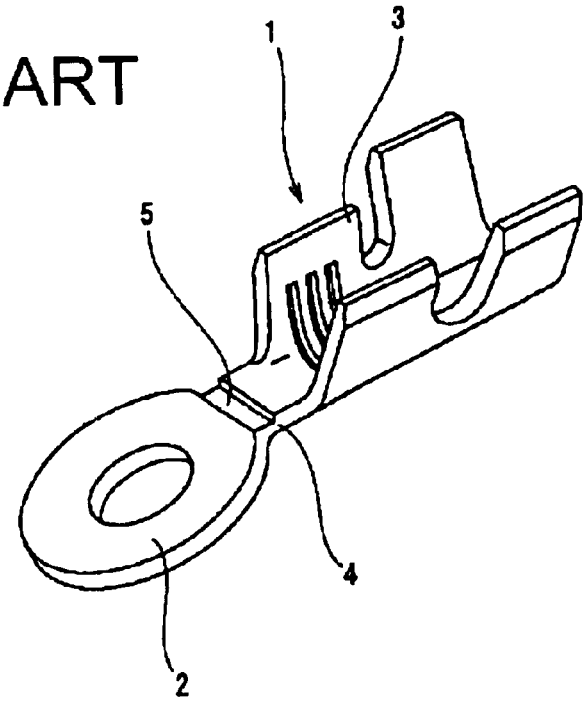
FIG. 7 PRIOR ART
FIG. 7 is a perspective view of a prior art ground terminal.

A ground terminal 31 of a third embodiment is shown in FIG. 6. The ground terminal 31 has fracture groove 35 with an apex 35*a* that is convex toward the fixing portion 12, and hence pointing in a direction opposite from the apex in the first and second embodiments. Accordingly, a projection 14*a* projecting from the rear surface is formed at a side of the fracture groove 35 toward the wire-connecting portion 13. Other elements are similar to or the same as the first embodiment, and these similar elements merely are identified by the same reference numerals. In the third embodiment, when the wire connecting portion 13 is lifted up, the ground terminal 31 is fractured and separated with the apex 35*a* of the fracture groove 35 as a fracture starting point located at a bottommost position of the portion being lifted in the lifting direction LD. Therefore, the third embodiment can be applied when no interfering part of the mount member A is located at this the portion to be fractured, because the bottommost portion needs to be lifted and does not remain in the mount member A as in the first and second embodiments.

What is claimed is:

1. A ground terminal formed from a metallic plate material having opposite front and rear surfaces, comprising:

a fixing portion formed with a bolt opening extending between the front and rear surfaces for receiving a bolt for fixing parts of the rear surface disposed on the fixing portion to a mount member;

a wire connecting portion for engaging a wire; and a coupling portion for coupling the fixing portion and the wire connecting portion;

wherein the coupling portion is formed with a fracture groove extending into the rear surface and thinned over the substantially entire width of the coupling portion, the fracture groove having a substantially pointed, shape.

2. The ground terminal of claim 1, wherein the fracture groove has an apex substantially symmetrically disposed on the coupling portion.

3. The ground terminal of claim 1, wherein a bore is formed at an apex of the pointed fracture groove.

4. A ground terminal of claim 2, comprising:

a fixing portion formed with a bolt opening for receiving a bolt for fixing the fixing portion to a mount member;

a wire connecting portion for engaging a wire; and a coupling portion for coupling the fixing portion and the wire connecting portion;

wherein the counting portion is formed with a fracture groove thinned over the substantially entire width thereof, the fracture groove having a substantially pointed shape with an apex substantially symmetrically disposed on the counting portion, and wherein the coupling portion has a projection proximate to a concave side of the apex of the fracture groove.

5. The ground terminal of claim 4, wherein the projection is projects on a surface opposite from the surface where the fracture groove formed.

6. A method for removing a ground wire from a mount member for recycling, comprising:

forming a ground terminal with a fixing portion having a bolt opening, a wire-connecting portion for engaging a wire, and a coupling portion coupling the fixing portion and the wire connecting portion, a fracture groove extending across a rear surface of the coupling portion, the fracture groove having a pointed shape, the fracture groove having an apex formed substantially symmetrically on the coupling portion and a projection on the coupling portion at a position proximate to a concave side of the apex of the fracture groove;

crimping the wire-connecting portion to the wire;

mounting the fixing portion to the mount member so that the rear surface of the coupling portion faces the mount member; and lifting the wire-connecting portion to fracture the coupling portion along the fracture groove.

7. The method of claim 6, wherein the projection projects from a surface opposite from the rear surface.

8. The method of claim 6, further comprising the step of forming a bore at the apex of the fracture groove.

9. A ground terminal formed from a piece of metallic material having opposite front and rear surfaces, said ground terminal comprising:

a substantially annular fixing portion formed with a bolt opening extending between the opposite front and rear surfaces for receiving a bolt for fixing the rear surface to a mount member;

a coupling portion projecting from an outer periphery of the fixing portion;

a wire connecting portion extending from the coupling portion and configured for connecting a wire to the front surface; and a fracture groove formed in the rear surface of the ground terminal and extending completely across the coupling portion, the fracture groove having a substantially pointed shape.

10. The ground terminal of claim 9, wherein the pointed shape points away from the fixing portion.

11. The ground terminal of claim 9, wherein the pointed shape points toward from the fixing portion.

12. The ground terminal of claim 9, wherein the pointed shape has a concave side, the coupling portion further being formed with a projection extending up from the front surface and proximate to the concave side of the pointed shape.

13. A ground terminal formed from a metallic material and having opposite front and rear surfaces, said terminal comprising:

a fixing portion formed with a bolt opening extending between the opposite front and rear surfaces for receiving a bolt for fixing the rear surface to a mount member;

a coupling portion at an outer periphery of the fixing portion;

a wire connecting portion extending from the coupling portion and having an elongate support extending in a longitudinal direction and at least one crimpable barrel extending transverse to the longitudinal direction for crimping a wire into connection with the wire connecting portion; and a fracture groove extending completely across the coupling portion and being configured such that at least a major part of said fracture groove is aligned to intersect the longitudinal direction of the wire connecting portion at an acute angle, such that at least one portion of said fracture groove is further from the crimpable barrel than other portions of said fracture groove.

14. The ground terminal of claim 13 wherein the fracture groove is substantially symmetrical with respect to the longitudinal direction of the wire connecting portion.

15. The ground terminal of claim 13 wherein the fracture groove is asymmetrical with respect to the longitudinal direction of the wire connecting portion.

16. The ground terminal of claim 13 wherein the fracture groove has opposite first and second ends dispose at opposite respective sides of the coupling portion, the first end of the fracture defining a shorter distance to the crimpable barrel than a distance between the second end of the fracture groove and the crimpable barrel.

* * * * *